United States Patent [19]

Harandi

[11] Patent Number: 4,664,784

[45] Date of Patent: May 12, 1987

[54] METHOD AND APPARATUS FOR FRACTIONATING HYDROCARBON CRUDES

[75] Inventor: Mohsen N. Harandi, Sewell, N.J.

[73] Assignee: Mobil Oil Corporation, New York, N.Y.

[21] Appl. No.: 829,856

[22] Filed: Feb. 14, 1986

Related U.S. Application Data

[63] Continuation of Ser. No. 687,789, Dec. 31, 1984, abandoned.

[51] Int. Cl.[4] ..... C10G 7/00

[52] U.S. Cl. ..... 208/354; 208/355; 208/356; 208/352; 208/358; 202/153; 203/88; 203/DIG. 19; 196/125

[58] Field of Search ..... 208/354, 355, 356, 350, 208/352, 358, 360; 202/153; 203/88, DIG. 19; 196/125

[56] References Cited

U.S. PATENT DOCUMENTS

| | | | |
|---|---|---|---|
| 2,149,943 | 3/1939 | Van Tonningen | 208/355 |
| 2,327,534 | 8/1943 | Lambert | 208/352 |
| 2,664,391 | 12/1953 | Coulter | 203/98 |
| 2,915,462 | 12/1959 | Salmon | 208/353 |
| 3,320,159 | 5/1967 | Potts | 208/363 |
| 3,383,308 | 5/1968 | Wickham et al. | 208/355 |
| 3,536,610 | 10/1970 | Stork | 208/340 |
| 3,567,628 | 3/1971 | Van Pool | 208/355 |
| 3,886,062 | 5/1975 | Peizer et al. | 208/354 |
| 3,976,179 | 8/1976 | Harrison et al. | 208/354 |
| 4,082,653 | 4/1978 | DeGraff | 208/354 |
| 4,239,618 | 12/1980 | Peiser et al. | 208/356 |
| 4,274,944 | 6/1981 | Bannan | 208/355 |
| 4,415,443 | 11/1983 | Murphy | 208/354 |

FOREIGN PATENT DOCUMENTS

| | | | |
|---|---|---|---|
| 610856 | 6/1978 | U.S.S.R. | 208/355 |

*Primary Examiner*—Andrew H. Metz
*Assistant Examiner*—A. Pal
*Attorney, Agent, or Firm*—Alexander J. McKillop; Michael G. Gilman; Malcolm D. Keen

[57] ABSTRACT

A method and apparatus are provided for distillation of hydrocarbon oil subject to coking threshold temperature limits. A hydrocarbon oil is heated to a first predetermined maximum temperature above which coking is likely to occur. The heated hydrocarbon oil is introduced into a first distillation zone, wherein the heated hydrocarbon oil is separated into a liquid portion and a vapor portion. The descending liquid portion is withdrawn from the bottom region of the first distillation zone, and the withdrawn liquid is reheated to a second predetermined maximum temperature, above which coking is likely to occur in the return heater line. Finally, the heated withdrawn liquid is returned to a second distillation zone, wherein a second separation occurs to achieve increased valuable products recovery. A divider arrangement maintains the first and second distillation zones physically separate from each other.

32 Claims, 5 Drawing Figures

METHOD AND APPARATUS FOR FRACTIONATING HYDROCARBON CRUDES

This is a continuation of copending application Ser. No. 687,789, filed on Dec. 31, 1984, now abandoned.

BACKGROUND OF THE INVENTION

1. Field of the Invention

This invention relates to a method and apparatus for physically separating hydrocarbon oil by fractional distillation into components having different boiling ranges, and more particularly, to method and apparatus for fractional distillation subject to coking threshold temperature limits.

2. Description of the Prior Art

In certain types of distillation towers, the inlet temperature of the material to be fractionated is limited to a maximum allowable temperature due to coking tendency of the hydrocarbon feed at high temperatures or due to other factors. In general, the higher the heat input to such distillation towers, the higher the desired product yield will be. Hereinafter, the terms "fractionator", "distillation tower", "vacuum tower" or the like refer to the above-described type of tower, where the hydrocarbon feed and products are subject to coking threshold temperatures. The above-noted coking threshold temperature depends upon the particular type of system involved, i.e., whether it is an atmospheric distillation tower, a vacuum tower, etc. In such systems, as a result of the pressure drop which occurs through the transfer line from the preheater outlet to the feed inlet to the distillation tower, in practice the temperature of the feed at the tower inlet is somewhat lower than the coking threshold temperature. This temperature drop results in less vapor and also more light ends remaining in the liquid portion of the inlet line to the tower. This in turn results in less vapor flashing upwardly in the tower and more liquid, which has more light ends content, descending in the tower. Further, the hydrocarbon partial pressure of the light ends causes more light ends to be absorbed in the liquid, with the same result as above. Hence, it is generally desirable to add heat to the above-noted type of distillation tower, provided the feed temperature coking threshold is not exceeded.

SUMMARY OF THE INVENTION

It is an object of the present invention to provide a method and apparatus for adding heat to a fractionation tower, while at the same time avoiding exceeding the feed temperature limit to achieve improved overall operation economy, and particularly, to provide greater valuable product recovery.

It is also an object of the present invention to provide a method and apparatus for distillation of hydrocarbon oil, wherein the bottoms product of the fractionator is minimized and desired hydrocarbon products are maximized.

According to the present invention, an improved distillation method is provided, comprising the steps of (a) introducing heated hydrocarbon feed into a first distillation zone to cause a first separation of the feed into a descending liquid portion and an ascending vapor portion; (b) withdrawing at least part of the liquid portion from the first distillation zone; (c) reheating the withdrawn liquid portion; and (d) introducing the reheated liquid portion into a second distillation zone to cause a second separation of the reheated liquid portion into a descending liquid portion and an ascending vapor portion.

The first and second distillation zones are maintained physically separate from each other. The first and second distillation zones can be disposed in a distillation tower and can be maintained physically separate from each other by divider means for causing substantially all of the descending liquid portions separated in step (a) to remain in the first distillation zone prior to being withdrawn therefrom in step (b), and substantially all of the descending liquid portions separated in step (d) to remain in the second distillation zone prior to being withdrawn therefrom as residuals product.

The divider means can comprise draw box or baffle means for directing substantially all of the descending liquid portions separated in step (a) to a bottom region of the first distillation zone, and substantially all of the descending liquid portions separated in step (d) to a bottom region of the second distillation zone. A flash zone in the distillation tower can comprise the first and second distillation zones, and the divider means can be disposed in the flash zone. Alternatively, the first distillation zone can comprise a flash zone in the distillation tower, the second distillation zone can comprise a stripping section disposed below the flash zone in the distillation tower and into which the reheated liquid portion is introduced in step (d), with the divider means being disposed in the stripping section.

A stripping section can be disposed below the second distillation zone for stripping the descending liquid portion separated in step (d) prior to its withdrawal as residuals product. Alternatively, a first stripping section can be disposed below the first distillation zone for stripping the descending liquid portion separated in step (a) prior to its withdrawal in step (b), and a second stripping section can be disposed below the second distillation zone for stripping the descending liquid portion separated in step (d) prior to its withdrawal as residuals product. Alternatively, the first distillation zone can comprise a flash zone of a distillation tower and the second distillation zone can comprise a flash drum or a stripper from which the overhead stream is fed to the distillation tower.

In any of the above cases, the distillation tower can comprise a vacuum distillation tower, an atmospheric distillation tower or the like. The heated hydrocarbon feed can be heated to a first predetermined maximum temperature below a coking threshold of the hydrocarbon feed, and the reheated liquid can be heated to a second predetermined maximum temperature below a coking threshold of the liquid portion withdrawn in step (b). The second predetermined maximum temperature can be greater than the first predetermined maximum temperature.

Also, according to the present invention, a distillation apparatus is provided which includes (a) distillation means comprising a first distillation zone and a second distillation zone; (b) means for introducing heated hydrocarbon feed into the first distillation zone to cause a first separation of the feed into a descending liquid portion and an ascending vapor portion; (c) means for withdrawing at least part of the liquid portion from the first distillation zone; (d) means for reheating the withdrawn liquid portion; and (e) means for introducing the reheated liquid portion into the second distillation zone to cause a separation of the reheated liquid portion into a descending liquid portion and an ascending vapor portion.

The apparatus can further include divider means for maintaining the liquid phases of the first and second distillation zones physically separate from each other. The first and second distillation zones can be disposed in a distillation tower, and the divider means can comprise means for causing substantially all of the descending liquid portions separated in the first distillation zone to remain in the first distillation zone prior to being withdrawn therefrom by the aforesaid means for withdrawing, and substantially all of the descending liquid portion separated in the second distillation zone to remain in the second distillation zone prior to being withdrawn therefrom as residuals product.

The divider means can comprise baffle means for directing substantially all of the descending liquid portion separated in the first distillation zone to a bottom region of the first distillation zone, and substantially all of the descending liquid portion separated in the second distillation zone to a bottom region of the second distillation zone. The distillation tower can include a flash zone which comprises the first and second distillation zones, and the divider means can be disposed in the flash zone. Alternatively, the first distillation zone can comprise a flash zone in the distillation tower, the second distillation zone can comprise a stripping section disposed below the flash zone in the distillation tower and into which the reheated liquid portion is introduced by the means for introducing, and the divider means can be disposed in the stripping section.

A stripping section can be disposed below the second distillation zone for stripping the descending liquid portion separated in the second distillation zone prior to its withdrawal as residuals product. Alternatively, a first stripping section can be disposed below the first distillation zone for stripping the descending liquid portion separated in the first distillation zone prior to its withdrawal by the aforesaid means for withdrawal, and a second stripping section can be disposed below the second distillation zone for stripping the descending liquid portion separated in the second distillation zone prior to its withdrawal as residuals product. Alternatively, the first distillation zone can comprise a flash zone of a distillation tower, and the second distillation zone can comprise a flash drum.

In any of the above cases, the distillation tower can comprise a vacuum distillation tower, an atmospheric distillation tower or the like. The heated hydrocarbon feed can be heated to a first predetermined maximum temperature below a coking threshold of the hydrocarbon feed, and the heated liquid portion can be heated to a second predetermined maximum temperature below a coking threshold of the liquid portion withdrawn by the means for withdrawing. The second predetermined maximum temperature can be greater than the first predetermined maximum temperature.

BRIEF DESCRIPTION OF THE DRAWINGS

The above and other objects, advantages and features of the present invention will be more fully understood when considered in conjunction with the following figures, of which.

DETAILED DESCRIPTION OF THE INVENTION

Figure 1:
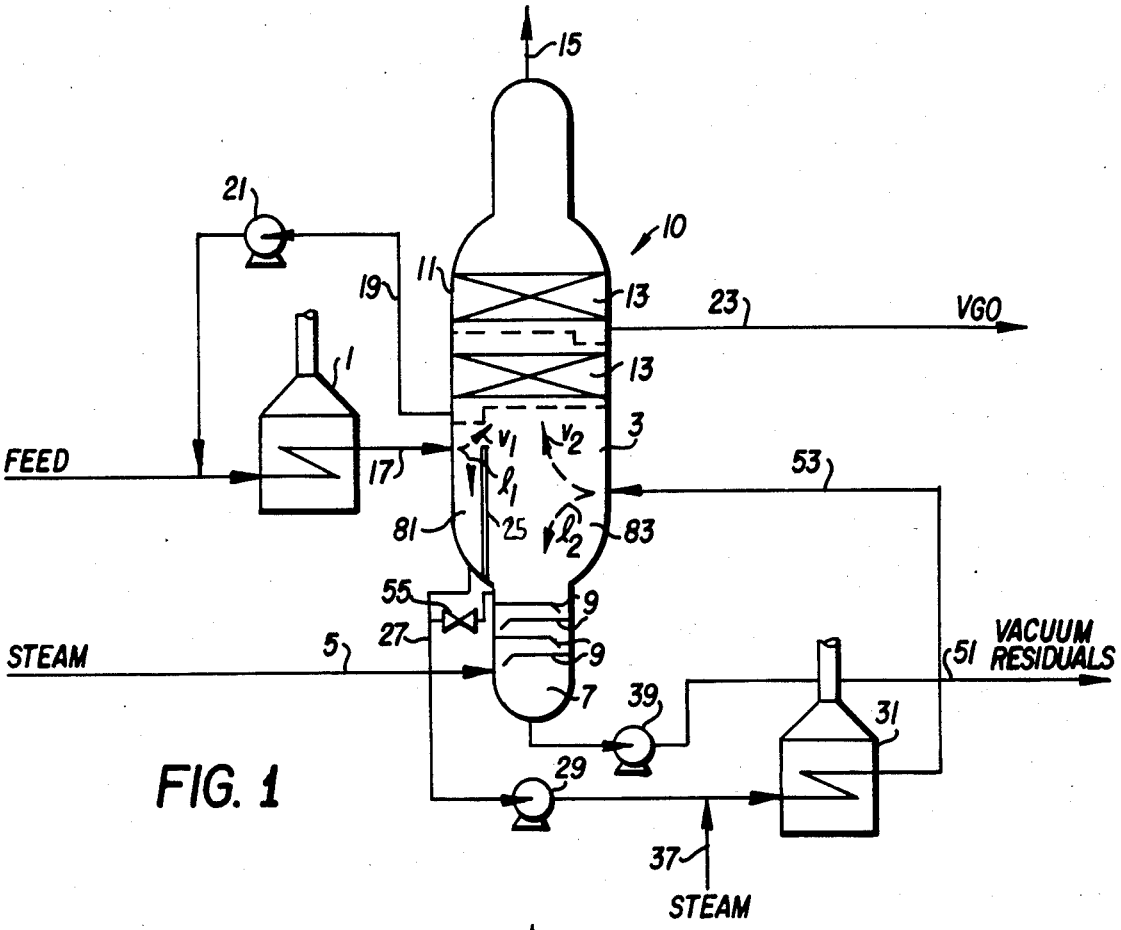
FIG. 1 illustrates a first embodiment of the present invention wherein the residuals heater return line is connected to the flash zone.

FIG. 1 illustrates a first embodiment of a system according to the present invention. While FIG. 1 illustrates a vacuum flash tower 10, it should be noted that the present invention is applicable to other types of distillation towers, e.g., atmospheric distillation towers. Further, the distillation tower product, e.g., vacuum gas oil provided along output line 23, could be fed either to a fluid catalytic converter reactor or could be a lube distillate.

In FIG. 1, hydrocarbon feed inlet furnace 1 provides a heated output to flash zone 3, which extends throughout the extent of the diameter of vacuum tower 10. Tower 10 is maintained at an absolute pressure of, e.g., 50 mm Hg, via steam ejectors (not shown). In a first distillation zone 81 of flash tower 10, the feed undergoes flash separation to produce a descending liquid portion containing relatively heavy ends and an ascending vapor portion containing relatively light ends, as shown by reference symbols $1_1$ and $v_1$ in FIG. 1. The vacuum tower includes various equipment (not shown) to minimize entrainment of pitch in the rising flash vapors and to aid in heat transfer between vapor and liquid. In practice, vapor and liquid are separated by a single-stage flash in zone 81 of flash zone 3 of tower 10.

Divider means formed of, e.g., a vertical baffle 25, is located in flash zone 3 to maintain first and second distillation zones 81 and 83 physically separate from each other. Divider means 25 causes substantially all of the descending liquid portion resulting from flash separtaion in zone 81 to stay in zone 81 prior to its being withdrawn therefrom via line 27. Thus, at least some, and preferably all, of the descending liquid portion is directed by divider means to a bottom region of distillation zone 82 of flash zone 3 to exit therefrom by way of residuals heater circuit exit line 27. It should be noted that while divider means 25 is shown as a vertical baffle 25, baffle 25 can alternatively be slanted, cylindrical, or any other shape, provided it functions to divide flash zone 3 into separate sections 81 and 83 and to direct the liquid portion as described above. Although it is preferable that all separated liquid be directed as aforesaid, any portion of this liquid portion which is not so directed will pass over divider means 25 into second distillation section 83 of flash zone 3, which is located on a side of divider 25 opposite to that on which residuals exit line 27 is located. Line 27 is connected to pump 29 to provide an output which is directed to residuals furnace 31. The reheated output of residuals furnace 31 is returned to second distillation zone 83 of flash zone 3 via line 53 on a side of divider 25, which is opposite to the side at which inlet line 17 is located, to cause a separation of this reheated output of furnace 31 into a descending liquid portion and an ascending vapor portion, as shown by reference symbols $l_2$ and $v_2$ in FIG. 1. Steam is injected via line 37 into the input line into residuals furnace 31 in order to inject additional heat into this furnace and to assist in preventing coking in furnace 31.

Below flash zone 3 in tower 10 is a lower stripping section 7 which contains a series of trays 9 through which stripping vapors and hydrocarbon vapors can pass in an upward direction. Each tray contains a layer of liquid through which the vapors can bubble, and the liquid can flow continuously by gravity in a downward direction from one tray to the next one below. As the vapors pass upwardly through the succession of trays, they become lighter (lower in molecular weight and more volatile), and the liquid flowing downwardly becomes progressively heavier (i.e., higher in molecular weight and less volatile). This countercurrent action results in further fractional distillation in stripping section 7. Above flash zone 3 in tower 10 is a fractionating section, e.g., packed beds 11 and 13 of inert material to provide surface area to enhance contact between rising gaseous vapors and hydrocarbon in liquid phase. It should be noted that, alternatively to packed beds 13, a succession of trays, similar to those in lower stripping section 7, could be used. Light gases which have passed through upper fractionation section 11 pass out of tower 10 through overhead 15.

Above feed inlet 17 to tower 10 is an output line 19 for recycling the overflash back to heater 1, after passing through pump 21. Vacuum gas oil product is removed along line 23.

It should be noted that exit line 27 has much less light ends than input line 17 to tower 10. Return line 53 to tower 10 also contains relatively fewer light ends than input line 17. Because a lower light hydrocarbon partial pressure exists in the liquid/gas mixture inside heater 31, as compared to heater 1, additional hydrocarbons will be vaporized from the residuals product. Further, the return line from heater 31 to tower 10 has a relatively low pressure drop, and hence a relatively low temperature drop, compared to the transfer line from preheater 1 to tower 10. Also, because of the lower pressure drop in return line 53, the heater 31 outlet can be operated at a lower pressure than the outlet of preheater 1. This is advantageous because at relatively lower heater outlet pressure, relatively more light ends will be vaporized, thus improving overall valuable product yield. In addition, heater 31 heats the liquid in return line 53 to a maximum allowable temperature to avoid coking in the return circuit. This limit temperature might be greater than the limit temperature associated with input line 17 depending upon various system parameters. Generally, by employing residuals heater 31 to reheat the liquid withdrawn via exit line 27 to a temperature greater than the temperature this liquid is at when withdrawn from tower 10, and then returning this reheated liquid to tower 10 via return line 53 results in a greater total recovery of light ends in tower 10 than if divider 25 and return residual furnace 31 were not employed.

Figure 2:
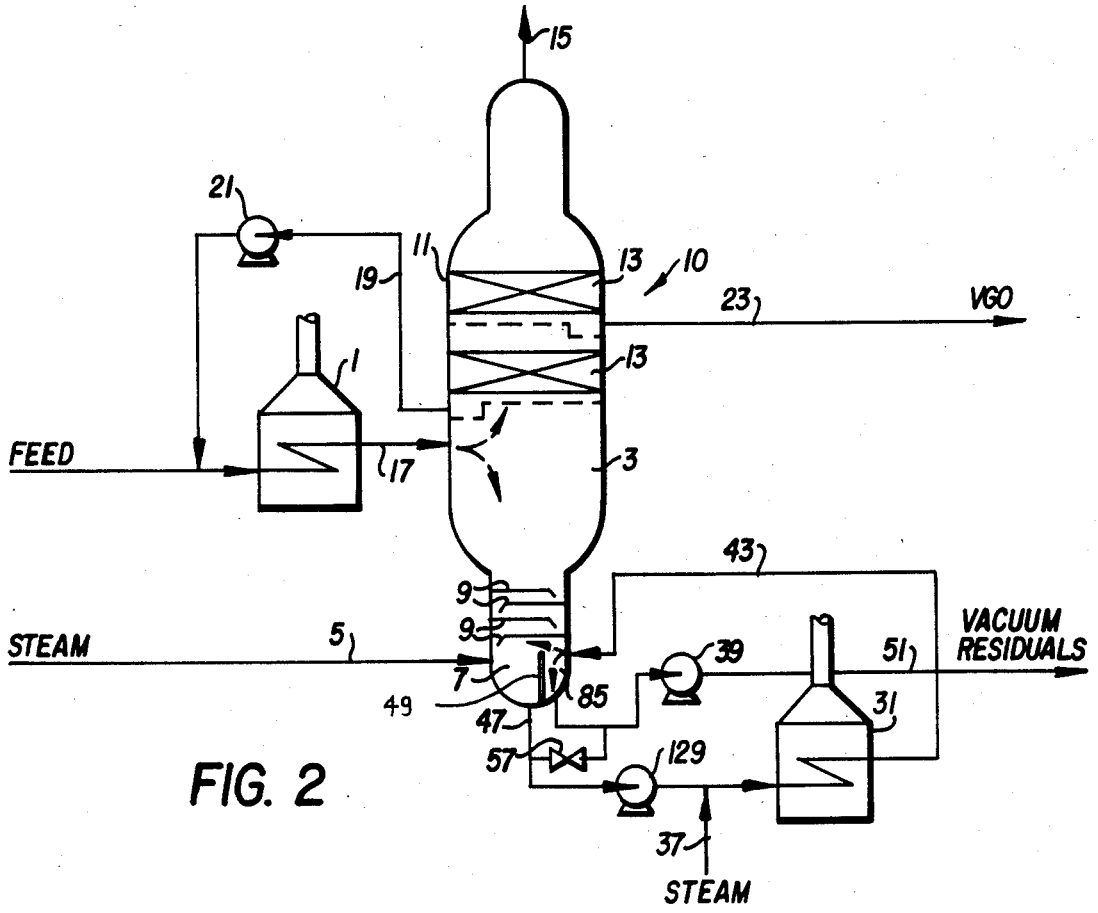
FIG. 2 illustrates a second embodiment wherein the residuals heater return line is connected to a lower stripping section below the flash zone.

FIG. 2 illustrates a second embodiment of the present invention, in which the first distillation zone comprises the entire flash zone 3, and residuals heater 31 has a return line 43 provided to a second distillation zone 85 located at a bottom portion of lower stripping section 7 of tower 10. This embodiment provides less valuable product yields than the abovedescribed first embodiment, but increased quality of yields. In the FIG. 2 embodiment, as in the FIG. 1 embodiment, a first separation of the heated hydrocarbon feed occurs in first distillation zone 3, while a second separation of the reheated, returned residuals occurs in second distillation zone 85. Vacuum residuals heater circuit exit line 47 is located at a bottom of lower stripping section 7 on one side of divider means, e.g., a substantially vertical baffle or draw box 49. Trays 9 are disposed, such that the descending liquid portion resulting from the flash separation in flash zone 3 is directed to a bottom region of lower stripping zone 7 to exit therefrom, after stripping, by way of vacuum residuals heater circuit exit line 47. Accordingly, in the embodiment shown in FIG. 2, the liquid feed provided by line 17 into tower 10 is first stripped in lower stripper 7 prior to withdrawing it and feeding it to residuals heater 31.

Residuals heater return line 43 returns reheated residuals to second distillation zone 85 on a side of divider means 49, which is opposite to the side at which exit line 47 is located. It should be noted that trays 9 are arranged so that, preferably, all or at least a major portion of the heavier components of the hydrocarbon liquids after stripping will descend to the side of baffle 49 on which residuals exit line 47 is located. As seen from FIG. 2, residuals heater return 43 provides heated residuals on the opposite side of baffle 49. As a result, a high degree of vaporization occurs on this last-named side of baffle 49. The unvaporized portions of the heated return residuals go out line 51.

In the FIG. 2 embodiment, the vaporized hydrocarbon components leaving residuals heater 31 are rectified by the flash zone 3 liquid, thus providing a more effective separation between vacuum gas oil and the residuals products. This results in a higher quality hydrocarbon product in the upper regions of the tower, but less volume of yields than in the FIG. 1 embodiment.

Figure 3:
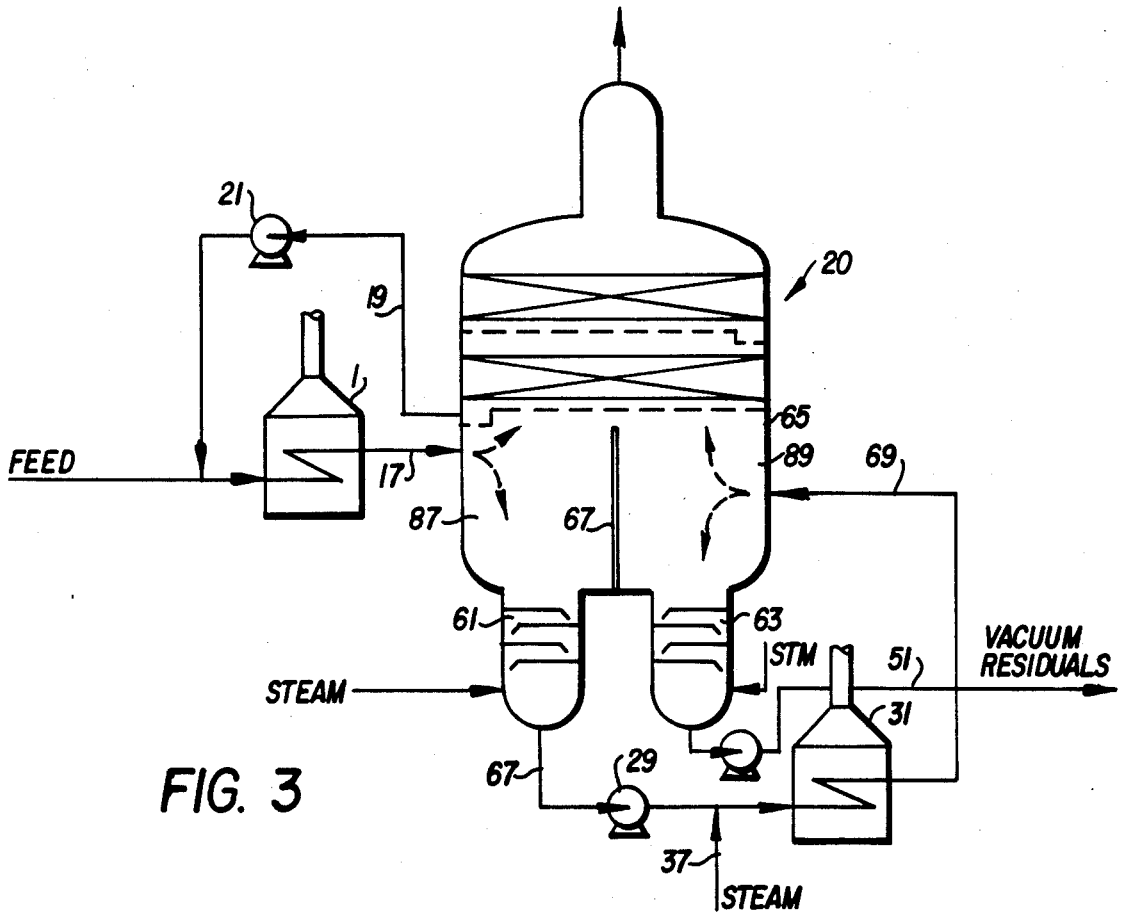
FIG. 3 illustrates a third embodiment wherein the distillation tower includes parallel lower stripping sections and the residuals heater return line is connected to the flash zone.

FIG. 3 illustrates a third embodiment, wherein tower 20 includes parallel separate lower stripping sections 61 and 63 and a flash zone 65. As seen from the dashed lines in flash zone 65, when feed from line 17 enters first distillation zone 87 of flash zone 65, it is separated into a liquid portion which flows downwardly and a vapor portion which flows upwardly. Divider means 67 is located in flash zone 65 for directing the liquid portion to stripping section 61 and for preventing this liquid from passing into second distillation zone 89 and stripping section 63. Preferably, all of the liquid portion is thereby directed into stripping section 61. Line 67 is connected to pump 29 to withdraw the bottoms product from section 61 and to introduce the same into residuals furnace 31. The reheated output of residuals furnace 31 is returned to second distillation zone 89 of flash zone 65 via line 69 on a side of divider means 67 opposite to the side at which inlet line 17 is located. Again, as seen from the dashed lines in FIG. 3, the return mixture is separated into a descending liquid portion and an ascending vapor portion. This liquid portion is stripped in stripping section 63, with residuals product being ultimately withdrawn along line 51. Otherwise, operation of the FIG. 3 embodiment is generally similar to those of the FIGS. 1 and 2 embodiments.

In the FIGS. 1, 2 and 3 embodiments described above, a primary advantage is that the vapor portion of the output of residuals heater 31 is returned to the distillation tower for separation. Without residuals heater 31, its associated return line, and a divider means as described above, the light ends portion of the liquid withdrawn via exit line 27 in FIG. 1, exit line 47 in FIG. 2, and exit line 67 in FIG. 3 would not be recovered.

It should be noted that in each of the above embodiments, separation of the vapor and the liquid components of the output of the residuals heater 31 is performed inside vacuum tower 10. This is advantageous in that it lowers the required equipment costs and also results in a lower pressure drop from heater 31 to the tower.

Figure 4:
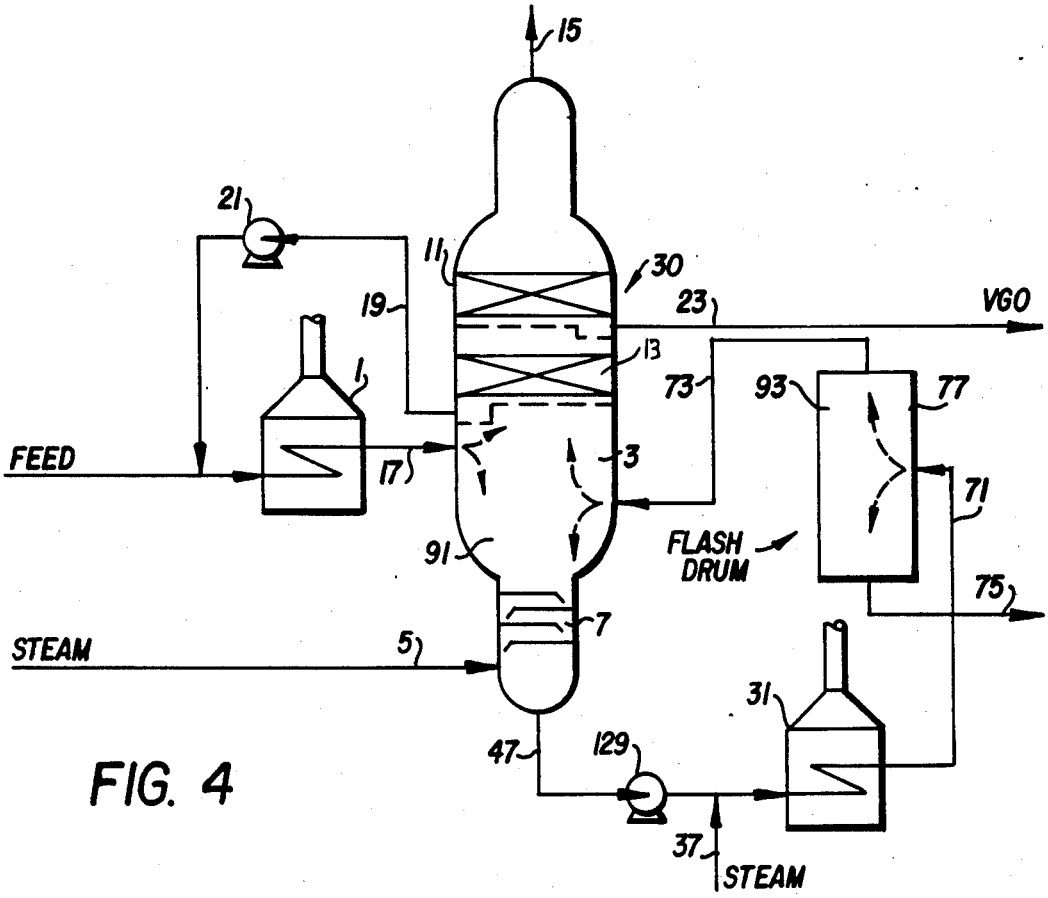
FIG. 4 illustrates a fourth embodiment in which a distillation system includes a flash zone, a lower stripping section and a second distillation zone comprising a flash drum, with the residuals heater return line being connected to the flash drum.

Alternatively, separation of the vapor and liquid components of the output of residuals heater 31 could be performed outside vacuum tower 10, using either a flash drum 77, as shown in FIG. 4, or a stripper between heater 31 and tower 10.

FIG. 4 illustrates a fourth embodiment, wherein tower 30 includes a first distillation zone 91 comprising flash zone 3, a lower stripping section 7, but contains no divider means, as is employed in the previous embodiment. Instead, the bottoms product from stripping section 7 is pumped to residuals heater 31, where it is reheated and then passed via line 71 into a second distillation zone 93 in flash drum 77, with the overhead product of flash drum 77 being passed into flash zone 3 along line 73 and the residuals from flash drum 77 being withdrawn along line 75. Alternatively, overhead product of flash drum 77 can be passed into the bottom of the stripping section of tower 30.

Figure 5:
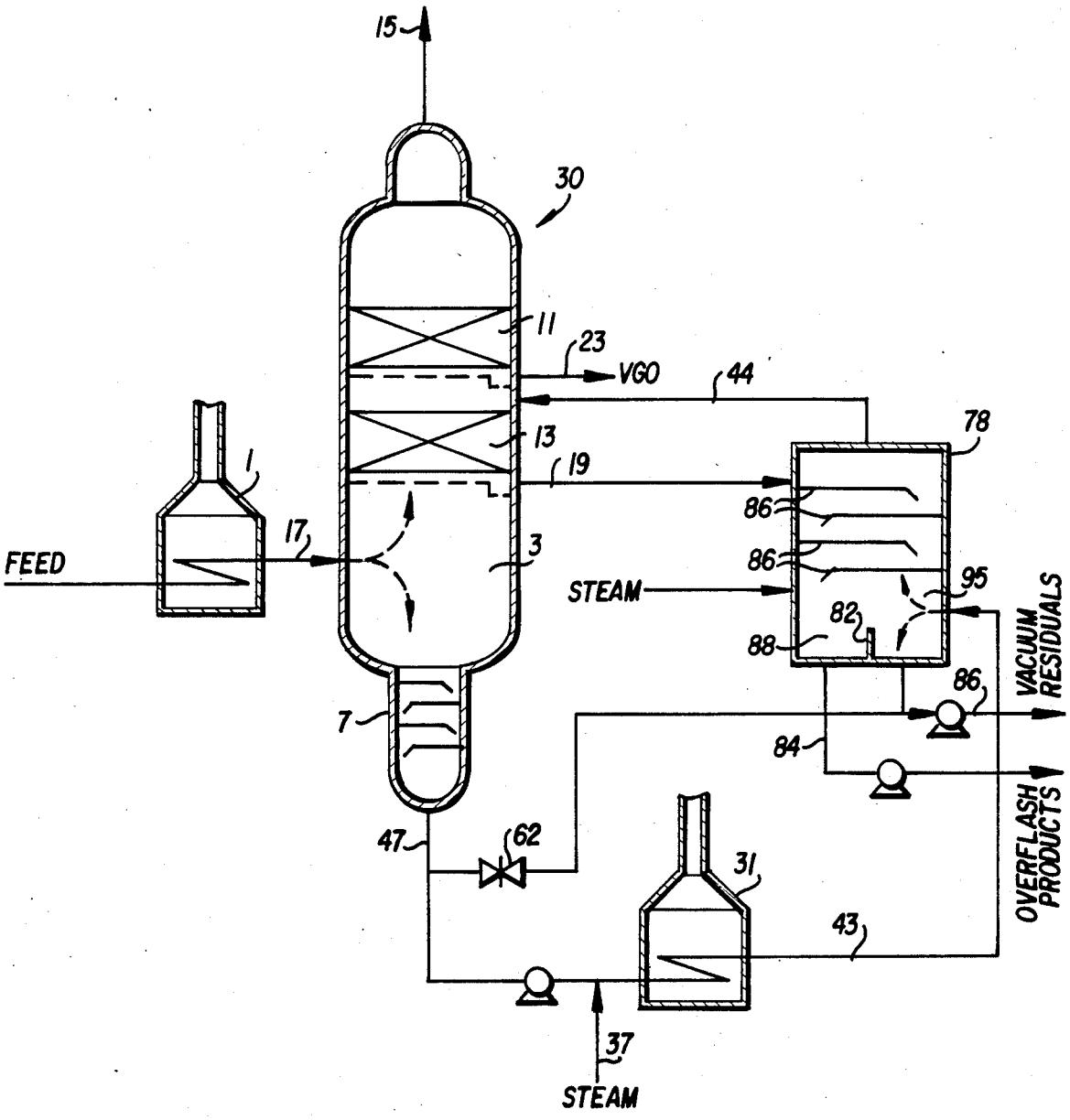
FIG. 5 illustrates a fifth embodiment in which a distillation system includes a flash zone, a lower stripping section and a second distillation zone comprising a stripper with the residuals heater return line being connected to the stripper and overhead stream from the stripper being fed to a distillation tower which includes the aforesaid flash zone.

FIG. 5 illustrates a fifth embodiment wherein tower 30 includes a first distillation zone 91 comprising flash zone 3 and a lower stripping section 7. Bottoms product from stripping section 7 is pumped to residuals heater 31 and then passed via line 43 into a second distillation zone 95 in stripper 78. Overhead product from stripper 78 is fed along line 44 to tower 30, while a side draw is fed from tower 30 via line 19 to stripper 78. Divider 82 is located at the bottom of stripper 78 and cooperates with trays 86 to direct liquid from tower 30 entering stripper 78 via line 19 to a bottom region 88 of stripper 78 to exit therefrom by way of overflash products line 84. The reheated output of furnace 31 is introduced into second distillation zone 95 at a side of divider 82 which is opposite to the side at which overflash products line 84 is located, to cause a separation of this reheated output of furnace 31 into a descending liquid portion, withdrawn along vacuum residuals line 86, and an ascending vapor portion. This ascending vapor portion contains some overflash materials and lighter components, e.g., VGO. The overflash materials are absorbed in the liquid phase in stripper 78 and will be directed by trays 86 and divider 82 to bottom region 88 to exit by way of overflash products line 84. The lighter components fromn stripper 78 will enter tower 30 for further fractionation.

By-pass valves 55 (FIG. 1), 57 (FIG. 2), 59 (FIG. 3), 60 (FIG. 4) and 62 (FIG. 5) can be provided to bypass the residuals return heater circuit and to revert to conventional operation, if necessary.

All of the above-described embodiments shown in FIGS. 1–5 constitute once-through systems. Because coking is a function of, among other factors, residence time, the once-through systems of the present invention, by minimizing residuals residence time throughout the system, are able to in turn minimize coking.

The examples discussed below are all based on computer simulations.

EXAMPLE I

In the FIG. 1 embodiment, using Arab light crude, the total vacuum residuals product is decreased by at least 3.4% over the prior art system, corresponding to approximately 1700 barrels per day vacuum gas oil increase for a 150,000 barrels per day vacuum tower.

EXAMPLE II

In the FIG. 2 embodiment, the residuals product is decreased by at least 2.3%, corresponding to approximately 1100 barrels per day vacuum gas oil yield increase for a 150,000 barrels per day vacuum tower. In this simulation, for the same vacuum gas oil yield, the vacuum gas oil Conradsen carbon residue (CCR) and metal content are approximately 3.2% less in the FIG. 2 embodiment, as compared to vacuum towers without a residuals heater as in FIG. 2.

EXAMPLE III

In this example, it is assumed that the pressure drop through the residuals heater transfer line is less than that through the feed transfer line. Also, an Arab light crude is used in the FIG. 1-type system, but the vacuum tower is used for lube distillates rather than for vacuum gas oil. Also, overflash products are drawn off from the vacuum tower. Based on the assumption that a lower pressure drop occurs through the residuals heater transfer line, compared to that through the feed heater transfer lines, a 7.2% reduction in residuals product is achieved and 69% of the recovered hydrocarbons are lube distilates and the remainder overflash products.

The data in all three examples above are based on the same simulated quantity of steam flow to the vacuum tower as that used in the simulation for a conventional system. Also, in Examples I and II, it is assumed that the pressure drop through the residuals heater and feed transfer lines are equal, a conservative assumption because the pressure drop through the residuals heater transfer line is smaller due to smaller flow. Thus, the residuals heater can be operated at lower pressures than assumed here, which means the vacuum gas oil yield increase will be higher.

The above description and the accompanying drawings are merely illustrative of the application of the principles of the present invention and are not limiting. Numerous other arrangements which embody the principles of the invention and which fall within its spirit and scope may be readily devised by those skilled in the art. Accordingly, the invention is not limited by the foregoing description, but is only limited by the scope of the appended claims.

I claim:

1. A distillation method, comprising:

(a) introducing heated hydrocarbon feed into a first distillation zone of a vacuum distillation means having first and second distillation zones physically separated from each other by divider means to cause a first separation of said feed into a descending liquid portion and an ascending vapor portion substantially all of the separated descending liquid remaining in the first distillation zone;

(b) withdrawing at least part of said liquid from said first distillation zone;

(c) reheating said withdrawn liquid portion;

(d) introducing said reheated liquid portion into a second distillation zone which is part of the same distillation column as said first distillation zone, to cause a second separation of said reheated liquid portion into a descending liquid portion and an ascending vapor portion substantially all of the reheated, separated descending liquid remaining in the second distillation zone; and (e) allowing return of vapor from said second distillation zone into a third distillation zone which is part of said same distillation column and which is provided for fractionating vapor from said first distillation zone and said second distillation zone.

2. The method as in claim 1, wherein said divider means comprises baffle means for directing substantially all of said descending liquid portions separated in step (a) to a bottom region of said first distillation zone and substantially all of said descending liquid portions separated in step (d) to a bottom region of said second distillation zone.

3. The method as in claim 1, wherein a flash zone in said distillation column comprises said first and second distillation zones and said divider means is disposed in said flash zone.

4. The method as in claim 1, wherein said first distillation zone comprises a flash zone in said distillation column, said second distillation zone comprises a stripping section disposed below said flash zone in said distillation column and into which said reheated liquid portion is introduced in step (d) and said divider means is disposed in said stripping section.

5. The method as in claim 3, further comprising a stripping section disposed below said second distillation zone for stripping said descending liquid portion separated in step (d) prior to its withdrawal as residuals product.

6. The method as in claim 3, further comprising a first stripping section disposed below said first distillation zone for stripping said descending liquid portion separated in step (a) prior to its withdrawal in step (b), and a second stripping section disposed below said second distillation zone for stripping said descending liquid portion separated in step (d) prior to its withdrawal as residuals product.

7. The method as in claim 1, wherein said heated hydrocarbon feed is heated to a first temperature below a coking threshold of said hydrocarbon feed and said reheated liquid portion is heated to a second temperature below a coking threshold of said liquid portion.

8. The method as in claim 7, wherein said second temperature is greater than said first temperature.

9. A distillation apparatus, comprising:

(a) vacuum distillation means comprising a first distillation zone;

(b) a second distillation zone which is part of the same distillation column as said first distillation zone, and separated from the first distillation zone by divider means to allow passage of vapor from said second distillation zone into a third distillation zone which is part of said same distillation column and which is provided for fractionating vapor from said first distillation zone and said second distillation zone;

(c) means for introducing heated hydrocarbon feed into said first distillation zone to cause a first separation of said feed into a descending liquid portion and an ascending vapor portion said divider means causing substantially all of the descending liquid portion separated in the first distillation zone to remain in the first distillation zone;

(d) means for withdrawing at least part of said liquid portion from said first distillation zone;

(e) means for reheating said withdrawn liquid portion; and (f) means for introducing said reheated liquid portion into said second distillation zone to cause a second separation of said reheated liquid portion into a descending liquid portion substantially all of which remains in said second distillation zone, and an ascending vapor portion which passes into the third distillation zone.

10. The apparatus as in claim 9, wherein said divider means comprises baffle means for directing substantially all of said descending liquid portion separated in said first distillation zone to a bottom region of said first distillation zone and substantially all of said descending liquid portion separated in said second distillation zone to a bottom region of said second distillation zone.

11. The apparatus as in claim 9, wherein a flash zone in said distillation column comprises said first and second distillation zones and said divider means is disposed in said flash zone.

12. The apparatus as in claim 9, wherein said first distillation zone comprises a flash zone in said distillation tower, said second distillation zone comprises a stripping section disposed below said flash zone in said distillation column and into which said reheated liquid portion is introduced by said means for introducing, and said divider means is disposed in said stripping section.

13. The apparatus as in claim 1, further comprising a stripping section disposed below said second distillation zone for stripping said descending liquid portion separated in said second distillation zone prior to its withdrawal as residuals product.

14. The apparatus as in claim 10, further comprising a first stripping section disposed below said first distillation zone for stripping said descending liquid portion separated in said first distillation zone prior to its withdrawal by said means for withdrawing and a second stripping section disposed below said second distillation zone for stripping said descending liquid portion separated in said second distillation zone prior to its withdrawal as residuals product.

15. A distillation method, comprising:

(a) introducing heated hydrocarbon feed into a first distillation zone to cause a first separation of said feed into a descending liquid portion and an ascending vapor portion;

(b) withdrawing at least part of said liquid from said first distillation zone;

(c) reheating said withdrawn liquid portion;

(d) introducing said reheated liquid portion into a second distillation zone which is part of the same distillation column as said first distillation zone and separated from the first distillation zone, to cause a second separation of said reheated liquid portion into a descending liquid portion and an ascending vapor portion;

(e) allowing return of vapor from said second distillation zone into a third distillation zone which is part of said same distillation column and which is provided for fractionating vapor from said first distillation zone and said second distillation zone; and (f) stripping said descending liquid portion separated in step (d) in a stripping section disposed below said second distillation zone, and (g) withdrawing the stripped liquid from step (f) as residuals product.

16. The method as in claim 15, wherein said distillation column comprises a vacuum distillation column.

17. The method as in claim 15, wherein said distillation column comprises an atmospheric distillation tower.

18. The method as in claim 15, wherein step (b) comprises withdrawing liquid from said first distillation zone without its passing through a stripping zone.

19. The method as in claim 15, further comprising stripping said descending liquid portion separated in step (a) prior to its withdrawal in step (b) in a first stripping section disposed below the first distillation zone.

20. The method as in claim 15, wherein said heated hydrocarbon feed is heated to a first temperature below a coking threshold of said hydrocarbon feed and said reheated liquid portion is heated to a second temperature below a coking threshold of said liquid portion.

21. The method as in claim 20, wherein said second temperature is greater than said first temperature.

22. A distillation apparatus, comprising:

(a) distillation means comprising a first distillation zone and a second distillation zone which is part of the same distillation column as said first distillation zone, and separated from the first distillation zone, said second distillation zone operating at a pressure at least as great as that of said first distillation zone to allow return of vapor from said second distillation zone into a third distillation zone which is part of said same distillation column and which is provided for fractionating vapor from said first distillation zone and said second distillation zone;

(b) means for introducing heated hydrocarbon feed into said first distillation zone to cause a first separation of said feed into a descending liquid portion which remains in the first distillation zone and an ascending vapor portion;

(c) means for withdrawing at least part of said liquid portion from said first distillation zone;

(d) means for reheating said withdrawn liquid portion;

(e) means for introducing said reheated liquid portion into said second distillation zone to cause a second separation of said reheated liquid portion into a descending liquid portion which remain in the second distillation zone and an ascending vapor portion; and (f) a first stripping section disposed below said second distillation zone for stripping said descending liquid portion separated in said second distillation zone prior to its withdrawal as residuals product.

23. The apparatus as in claim 22, wherein said distillation column comprises a vacuum distillation column.

24. The apparatus as in claim 22, wherein said distillation column comprises an atmospheric distillation column.

25. The apparatus as in claim 22, further comprising means for withdrawing liquid from said first distillation zone without its passing through a stripping zone.

26. The apparatus as in claim 22, further comprising a second stripping section disposed below said first distillation zone for stripping said descending liquid portion separated in said first distillation zone prior to its withdrawal by said means for withdrawing said liquid portion.

27. A distillation method, comprising:

(a) introducing heated hydrocarbon feed into a first distillation zone of a distillation means to cause a first separation of said feed into a descending liquid portion and an ascending vapor portion;

(b) withdrawing at least part of said liquid from said first distillation zone;

(c) reheating said withdrawn liquid portion;

(d) introducing said reheated liquid portion into a second distillation zone located in a separate vessel from that containing said first distillation zone, said separate vessel containing no side draws, said second distillation zone operating at a pressure at least as great as that of said first distillation zone to cause a second separation of said reheated liquid portion into a descending liquid portion and an ascending vapor portion; and (e) allowing return of vapor from said second distillation zone into a distillation means provided for fractionating vapor from said first distillation zone.

28. The method as in claim 27, wherein said first distillation zone comprises a flash zone of a distillation tower, said second distillation zone comprises a flash drum, and overhead product from said flash drum is introduced into said distillation tower.

29. The method as in claim 27, wherein said first distillation zone comprises a flash zone of a distillation tower, said second distillation zone comprises a stripper, a side product of said distillation tower is introduced into said stripper, and overhead product of said stripper is introduced into said distillation tower.

30. A distillation apparatus, comprising:

(a) distillation means comprising a first distillation zone;

(b) a second distillation zone located in a separate vessel from that containing said first distillation zone, said separate vessel containing no side draws, said second distillation zone operating at a pressure at least as great as that of said first distillation zone to allow return of vapor from said second distillation zone into a distillation means provided for fractionating vapor from said first distillation zone;

(c) means for introducing heated hydrocarbon feed into said first distillation zone to cause a first separation of said feed into a descending liquid portion and an ascending vapor portion;

(d) means for withdrawing at least part of said liquid portion from said first distillation zone;

(e) means for reheating said withdrawn liquid portion; and (f) means for introducing said reheated liquid portion into said second distillation zone to cause a second separation of said reheated liquid portion into a descending liquid portion and an ascending vapor portion.

31. The apparatus as in claim 30, wherein said first distillation zone comprises a flash zone of a distillation tower and said second distillation zone comprises a flash drum having an overhead line connected to said distillation tower.

32. The apparatus as in claim 30, wherein said first distillation zone comprises a flash zone of a distillation tower, said second distillation zone comprises a stripper having an overhead line connected to said distillation tower and said distillation tower includes a side draw connected to said stripper.

* * * * *